US007374416B2

(12) United States Patent
Cook et al.

(10) Patent No.: US 7,374,416 B2
(45) Date of Patent: May 20, 2008

(54) APPARATUS AND METHOD FOR CONTROLLED WIDTH EXTRUSION OF FILAMENTARY CURTAIN

(75) Inventors: Michael C. Cook, Marietta, GA (US); Bryan David Haynes, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 656 days.

(21) Appl. No.: 10/718,761

(22) Filed: Nov. 21, 2003

(65) Prior Publication Data

US 2005/0110185 A1 May 26, 2005

(51) Int. Cl.
*B29C 47/00* (2006.01)

(52) U.S. Cl. ..... 425/382.3; 425/382.2; 425/382.4; 425/464; 425/132

(58) Field of Classification Search ..... 425/381, 425/192 S, 72.2, DIG. 217, 382.2, 382.4, 425/382.3, 464, 132
See application file for complete search history.

(56) References Cited

U.S. PATENT DOCUMENTS 3,692,618 A 9/1972 Dorschner et al.
3,802,817 A 4/1974 Matsuki et al.
3,825,380 A 7/1974 Harding et al.
3,849,241 A 11/1974 Butin et al.
3,912,439 A * 10/1975 Newman, Jr. ..... 425/308
4,013,816 A 3/1977 Sabee et al.
4,242,075 A 12/1980 Higuchi et al.
4,340,563 A 7/1982 Appel et al.
4,479,768 A * 10/1984 Kube et al. ..... 425/192 R
4,486,161 A 12/1984 Middleton
4,887,957 A 12/1989 Ohta et al.
4,934,916 A 6/1990 Lambertus
5,067,885 A * 11/1991 Stevenson et al. ..... 425/131.1
5,108,820 A 4/1992 Kaneko et al.
5,147,197 A * 9/1992 Hodan et al. ..... 425/192 S
5,272,236 A 12/1993 Lai et al.
5,278,272 A 1/1994 Lai et al.
5,332,613 A 7/1994 Taylor et al.
5,336,552 A 8/1994 Strack et al.

(Continued)

FOREIGN PATENT DOCUMENTS

EP 0093358 A1 11/1983

(Continued)

*Primary Examiner*—Yogendra N. Gupta
*Assistant Examiner*—Maria Veronica Ewald
(74) *Attorney, Agent, or Firm*—Nancy M. Klembus; Robert A. Ambrose

(57) ABSTRACT

The invention provides a method for controlling the width of a plurality of extruded filaments comprising providing a polymer supply and an extrusion die comprising a plurality of extrusion capillaries and a plurality of counterbores allowing fluid communication between the extrusion capillaries and polymer supply, providing an adjustable insert for interrupting fluid communication between the polymer supply and at least one extrusion capillary, providing at least one fluidized polymer, conveying the polymer through the polymer supply, counterbores and extrusion capillaries to extrude a plurality of filaments, and interrupting the fluid communication between the polymer supply and at least one extrusion capillary by adjusting the insert. An apparatus for extruding filaments is also provided, comprising an extrusion die, polymer supply, extrusion capillaries, counterbores allowing fluid communication between the capillaries and polymer supply, and an adjustable insert for interrupting fluid communication between the polymer supply and at least one extrusion capillary.

2 Claims, 15 Drawing Sheets

U.S. PATENT DOCUMENTS 5,382,400 A 1/1995 Pike et al.
5,385,775 A 1/1995 Wright et al.
5,397,227 A * 3/1995 Hodan et al. ..... 425/192 S
5,531,587 A * 7/1996 Meidhof ..... 425/382 R
5,539,056 A 7/1996 Yang et al.
5,591,458 A * 1/1997 Froeschke et al. ..... 425/6
5,596,052 A 1/1997 Resconi et al.
6,120,276 A 9/2000 Balk
6,164,950 A 12/2000 Barbier et al.
6,579,084 B1 6/2003 Cook

FOREIGN PATENT DOCUMENTS

WO WO 92/07121 4/1992
WO WO 01/88245 11/2001

* cited by examiner

APPARATUS AND METHOD FOR CONTROLLED WIDTH EXTRUSION OF FILAMENTARY CURTAIN

FIELD

The present invention is related to an apparatus for controlled width extrusion of a filamentary curtain or filamentary web, and to a method for controlling the extruded width of a curtain of filaments.

BACKGROUND OF THE INVENTION

Many of the medical care garments and products, protective wear garments, mortuary and veterinary products, and personal care products in use today are partially or wholly constructed of extruded filamentary web materials such as nonwoven web materials. Examples of such products include, but are not limited to, medical and health care products such as surgical drapes, gowns and bandages, protective workwear garments such as coveralls and lab coats, and infant, child and adult personal care absorbent articles such as diapers, training pants, disposable swimwear, incontinence garments and pads, sanitary napkins, wipes and the like. Other uses for extruded filamentary web materials include geotextiles and house wrap materials. For these applications extruded filament web materials provide functional, tactile, comfort and/or aesthetic properties that can approach or even exceed those of traditional woven textiles or knitted cloth materials, yet these products must be manufactured at a cost that is consistent with single- or limited-use disposability.

Various types of equipment for making extruded filament web materials by extruding a plurality or curtain of filaments are well known in the art, and are available in a variety of widths such as 1 meter and 2 meter wide filament extrusion dies and as large as 5 meter wide filament extrusion dies. However, where it is desired that the extruded web of filaments produced by such apparatus be less wide than the full extrusion width of the apparatus or extrusion die, the extra width of the thus-produced filamentary web must be trimmed off and either discarded or somehow recycled back into the filament extrusion process. It would be highly desirable to be able to control the extruded width of the filamentary curtain in-process in order to avoid or decrease the waste associated with trimming substantial portions of the width of the product.

Therefore, there is a continuing need for efficient and controllable filament extrusion apparatus and methods for extruding filaments.

SUMMARY OF THE INVENTION

The present invention provides a method for controlling the cross machine direction width of a plurality of extruded filaments, the method including the steps of providing a polymer supply and an extrusion die in fluid communication with the polymer supply, the extrusion die comprising extrusion capillaries and counterbores allowing fluid communication between the extrusion capillaries and the polymer supply, and providing at least one adjustable insert for interrupting the fluid communication between the polymer supply and at least one of the extrusion capillaries, providing at least one fluidized polymer, conveying the polymer through the polymer supply, counterbores and extrusion capillaries to extrude filaments, and interrupting the fluid communication between the polymer supply and at least one of the extrusion capillaries by adjusting the insert.

The adjustable insert may be a plate, such as a plate having a rectangular cross section, or may be a rod having a substantially circular cross section. The adjustable insert may have a plurality of spaced apart holes through it. The fluid communication may be interrupted by moving the insert axially or by rotating the insert. In embodiments, a second adjustable insert may be provided. In embodiments, the adjustable insert may be a rod having a substantially circular cross section, a diameter and a length, and the rod having at least a first portion and a second portion along its length, the first portion having at a plurality of spaced apart locations a single hole through the diameter, and the second portion having at a plurality of spaced apart locations at least two holes through the diameter, wherein the fluid communication is interrupted to a first plurality of extrusion capillaries by a first rotational adjustment of the insert, and wherein the fluid communication is interrupted to a second plurality of the extrusion capillaries by a second rotational adjustment of the insert.

The invention further provides an apparatus for extruding filaments, the apparatus comprising an extrusion die, a polymer supply in fluid communication with the extrusion die, a plurality of extrusion capillaries in the extrusion die, a plurality of counterbores in the extrusion die allowing fluid communication between the capillaries and polymer supply, and an adjustable insert for interrupting the fluid communication between the polymer supply and at least one of the extrusion capillaries. The adjustable insert may be, for example, a solid plate such as a plate having a rectangular cross section, or a rod having a substantially circular cross section, and the rod or the plate may have spaced apart holes through it or may be a substantially solid rod or substantially solid plate.

In embodiments, the insert is a rod having a substantially circular cross section, a diameter and a length, the rod having at least a first portion and a second portion along its length, the first portion having at a plurality of spaced apart locations a single hole through the diameter, and the second portion having at a plurality of spaced apart locations at least two holes through the diameter. In another embodiment, the apparatus further comprises a second adjustable insert, where the second adjustable insert is a rod having a substantially circular cross section, a diameter and a length, the rod having at least a first portion and a second portion along its length, the first portion having at a plurality of spaced apart locations a single hole through the diameter, and the second portion having at a plurality of spaced apart locations at least two holes through the diameter.

DEFINITIONS

Figure 1A:
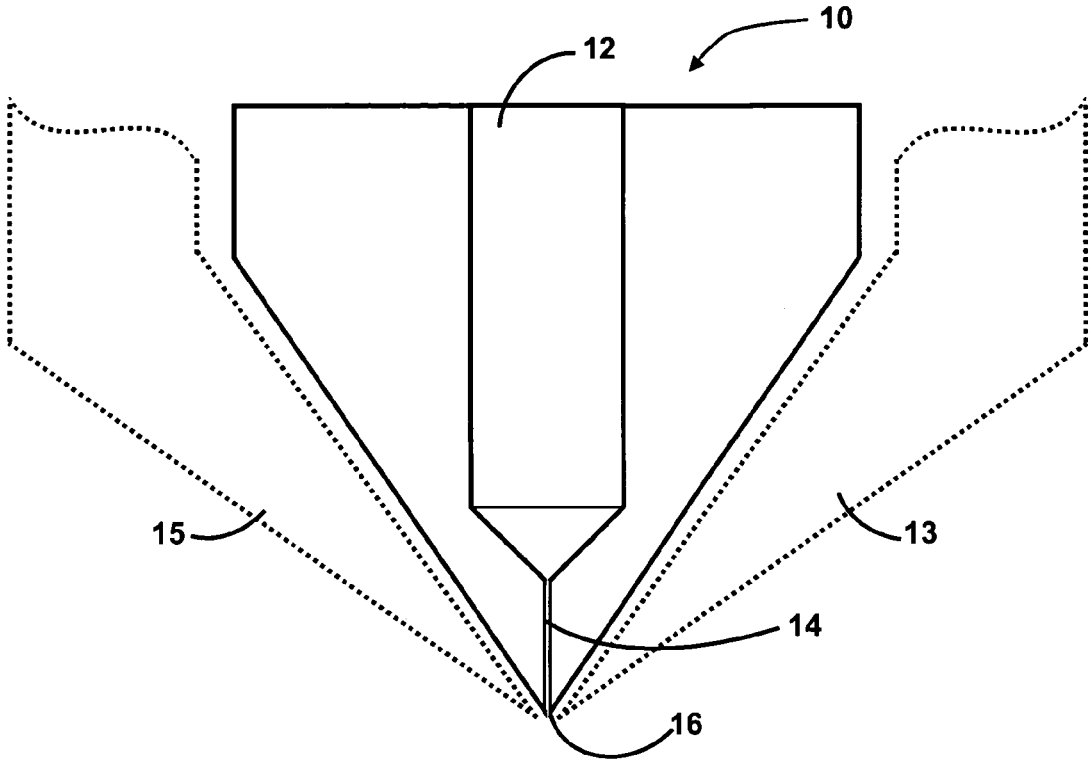
FIG. 1A (Prior Art)
FIGS. 1A-1B illustrate schematically a meltblown die.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries. As used herein the term "thermoplastic" or "thermoplastic polymer" refers to polymers that will soften and flow or melt when heat and/or pressure are applied, the changes being reversible.

As used herein the term "fibers" refers to both staple length fibers and substantially continuous filaments, unless otherwise indicated. As used herein the term "substantially continuous" with respect to a filament or fiber means a filament or fiber having a length much greater than its diameter, for example having a length to diameter ratio in excess of about 15,000 to 1, and desirably in excess of 50,000 to 1.

As used herein the term "monocomponent" filament refers to a filament formed from one or more extruders using only one polymer. This is not meant to exclude filaments formed from one polymer to which small amounts of additives have been added for color, anti-static properties, lubrication, hydrophilicity, etc.

As used herein the term "multicomponent filaments" refers to filaments that have been formed from at least two component polymers, or the same polymer with different properties or additives, extruded from separate extruders but spun together to form one filament. Multicomponent filaments are also sometimes referred to as conjugate filaments or bicomponent filaments, although more than two components may be used. The polymers are arranged in substantially constantly positioned distinct zones across the cross-section of the multicomponent filaments and extend continuously along the length of the multicomponent filaments. The configuration of such a multicomponent filament may be, for example, a concentric or eccentric sheath/core arrangement wherein one polymer is surrounded by another, or may be a side by side arrangement, an "islands-in-the-sea" arrangement, or arranged as pie-wedge shapes or as stripes on a round, oval or rectangular cross-section filament, or other. Multicomponent filaments are taught in U.S. Pat. No. 5,108,820 to Kaneko et al., U.S. Pat. No. 5,336,552 to Strack et al., and U.S. Pat. No. 5,382,400 to Pike et al. For two component filaments, the polymers may be present in ratios of 75/25, 50/50, 25/75 or any other desired ratios. In addition, any given component of a multicomponent filament may desirably comprise two or more polymers as a multiconstituent blend component.

As used herein the term "biconstituent filament" or "multiconstituent filament" refers to a filament formed from at least two polymers, or the same polymer with different properties or additives, extruded from the same extruder as a blend. Multiconstituent filaments do not have the polymer components arranged in substantially constantly positioned distinct zones across the cross-section of the multicomponent filaments; the polymer components may form fibrils or protofibrils that start and end at random.

As used herein the term "nonwoven web" or "nonwoven fabric" means a web having a structure of individual filaments or filaments that are interlaid, but not in an identifiable manner as in a knitted or woven fabric. Nonwoven fabrics or webs have been formed from many processes such as for example, meltblowing processes, spunbonding processes, airlaying processes, and carded web processes. The basis weight of nonwoven fabrics is usually expressed in grams per square meter (gsm) or ounces of material per square yard (osy) and the filament diameters useful are usually expressed in microns. (Note that to convert from osy to gsm, multiply osy by 33.91).

The term "spunbond" or "spunbond nonwoven web" refers to a nonwoven fiber or filament material of small diameter filaments that are formed by extruding molten thermoplastic polymer as filaments from a plurality of capillaries of a spinneret. The extruded filaments are cooled while being drawn by an eductive or other well known drawing mechanism. The drawn filaments are deposited or laid onto a forming surface in a generally random manner to form a loosely entangled filament web, and then the laid filament web is subjected to a bonding process to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al. Typically, spunbond fibers or filaments have a weight-per-unit-length in excess of about 1 denier and up to about 6 denier or higher, although both finer and heavier spunbond filaments can be produced. In terms of filament diameter, spunbond filaments often have an average diameter of larger than 7 microns, and more particularly between about 10 and about 25 microns, and up to about 30 microns or more.

As used herein the term "meltblown fibers" means fibers or microfibers formed by extruding a molten thermoplastic material through a plurality of fine, usually circular, die capillaries as molten threads filaments or fibers into converging high velocity gas (e.g. air) streams that attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are often smaller than 10 microns in average diameter and are frequently smaller than 7 or even 5 microns in average diameter, and are generally tacky when deposited onto a collecting surface.

DETAILED DESCRIPTION OF THE INVENTION

The present invention provides an apparatus and method for controlled-width extrusion of a filamentary curtain by use of an adjustable die insert. The invention will be described with reference to the following Figures which illustrate certain embodiments. It will be apparent to those skilled in the art that these embodiments do not represent the full scope of the invention which is broadly applicable in the form of variations and equivalents as may be embraced by the claims appended hereto. It is intended that the scope of the claims extend to all such variations and equivalents. As disclosed herein, the extruded width of a curtain of extruded filaments may be controlled by selectively interrupting or occluding fluid communication to the filament extrusion capillaries, from one or both ends or sides of the extrusion apparatus, thus narrowing the extruded width of the filamentary curtain.

Figure 1B:
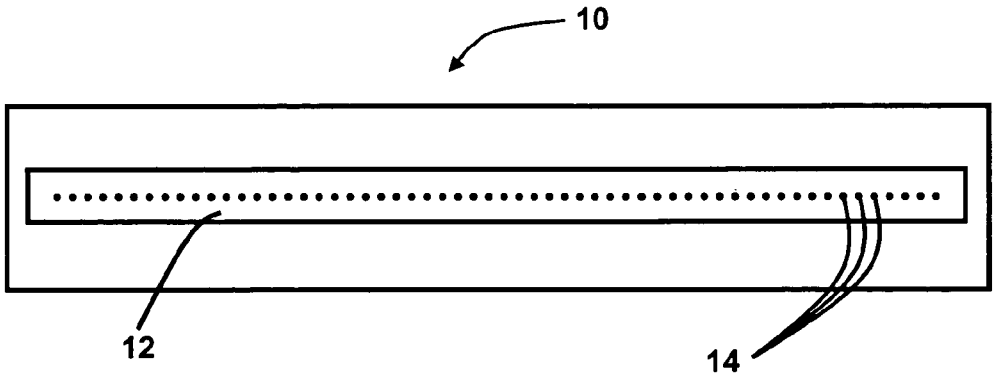

FIG. 1A illustrates in side view a cut-away diagram of a meltblowing type die as is generally known in the art. As can be seen in FIG. 1A, the meltblown die generally comprises a single deep polymer distribution channel 12 which is a cavity formed as a slot in the die 10 and running substantially the length of the die 10, and extrusion capillaries 14 are drilled or otherwise formed extending from the bottom of the polymer distribution slot to the extrusion edge 16 of the die. FIG. 1B shows schematically a top view (rotated 90 degrees) of the meltblown die shown in FIG. 1A. As can be seen in FIG. 1B, the die 10 includes polymer distribution channel 12 which is a cavity running along the majority of the width of the die 10 and a plurality of extrusion capillaries 14, which are generally arranged in a single row along the cross machine direction width of the meltblown die. In use, molten polymer is supplied or pumped to the die 10 by a polymer supply (not shown) and, because all the elements of the extrusion die are in uninterrupted fluid communication, the polymer is conveyed or flows through polymer distribution channel 12 to extrusion capillaries 14 and is extruded as fine threads or filaments or fibers of molten polymer (not shown) from capillaries 14 at extrusion edge 16.

Typically, the fibers or filaments of molten polymer are extruded into converging high velocity gas streams (such as heated or unheated air) which attenuate the fibers of molten thermoplastic material to reduce their diameter. The converging high velocity gas streams are supplied along the sides of the meltblown die through the slots formed between the die and the air plates 13 and 15 that are shown in FIG. 1A in phantom. Air plates for a meltblowing apparatus are well known to those of ordinary skill in the art and thus are not described here in detail. Generally, the air plates may be configured such that the extrusion edge of the meltblown die is flush with the bottom of the air plates (at the same vertical level), or the extrusion edge of the meltblown die may be recessed (higher than the bottom of the air plates), or extrusion edge of the meltblown die may protrude below the bottom of the air plates.

Figure 2A:
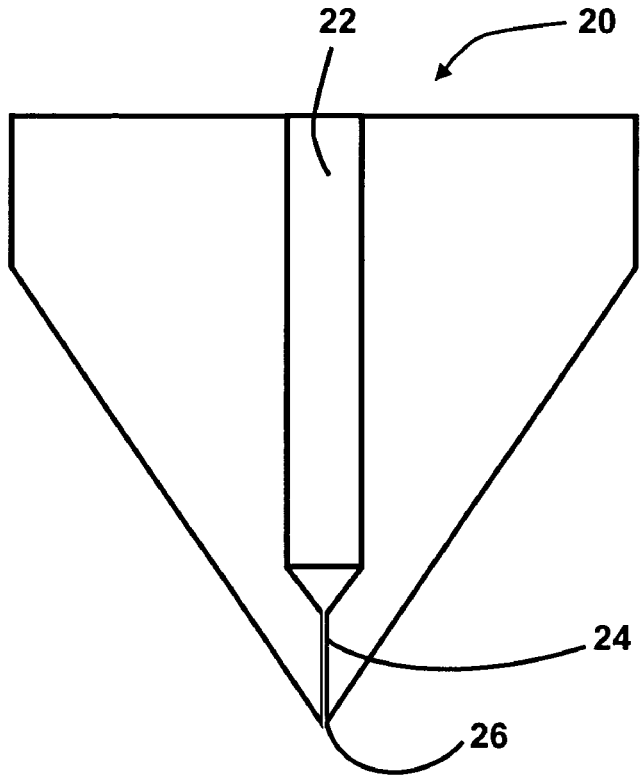
FIG. 2A (Prior Art)
FIGS. 2A-2B and 3A-3B illustrate schematically other meltblown dies.
Figure 2B:
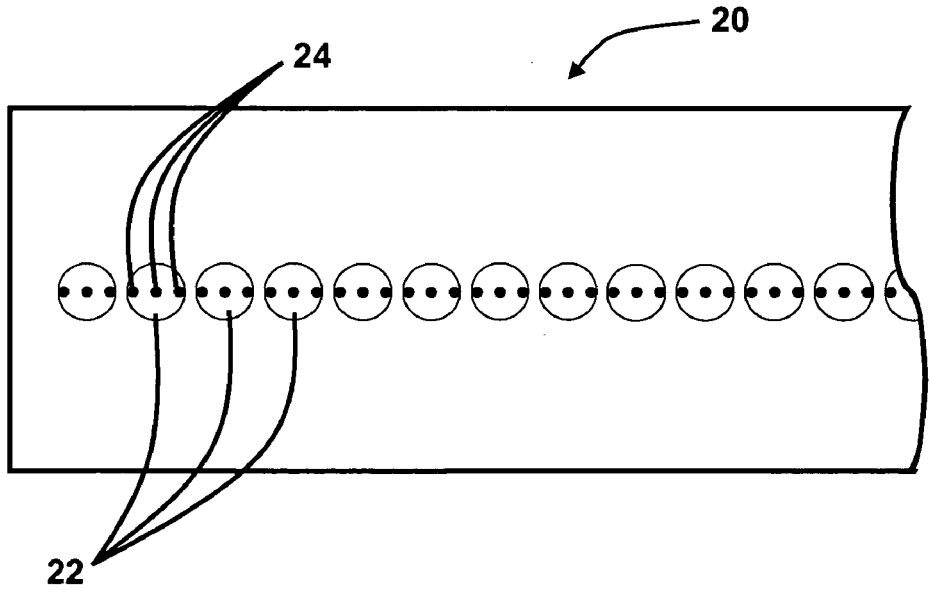

In FIGS. 2A-2B and 3A-3B are shown other embodiments of a meltblown die having counterbores such as the meltblown dies disclosed in co-assigned U.S. Pat. No. 6,579,084 to Cook, incorporated herein by reference in its entirety. FIG. 2A illustrates in side view a cut-away diagram of a meltblowing type die 20 having counterbores 22 rather than the single deep polymer distribution channel or slot as was illustrated in FIGS. 1A and 1B. The counterbores will generally be cylindrical in shape, although this is not required. Extrusion capillaries 24 are drilled or otherwise formed extending from the bottom of or near the bottom of counterbore 22 to the extrusion edge 26 of the die. FIG. 2B shows schematically a top view (rotated 90 degrees) of the meltblown die shown in FIG. 2A. As can be seen in FIG. 2B, the die 20 includes a plurality of counterbores 22 along the majority of the width of the die and having a plurality of extrusion capillaries 24. In the embodiment shown, each counterbore 22 supplies polymer to three capillaries 24. The number of extrusion capillaries per counterbore may of course be less than or greater than the three shown.

Figure 3A:
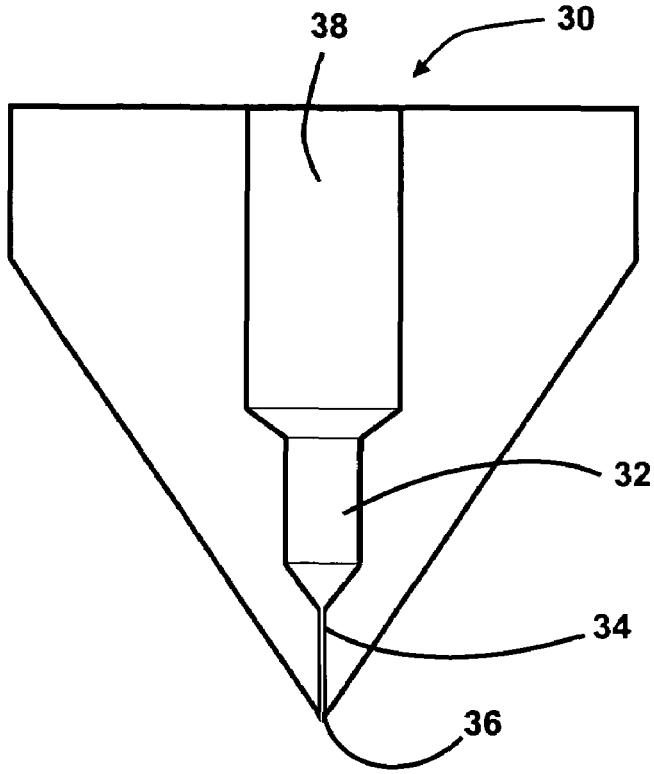
FIG. 3A (Prior Art)
Figure 3B:
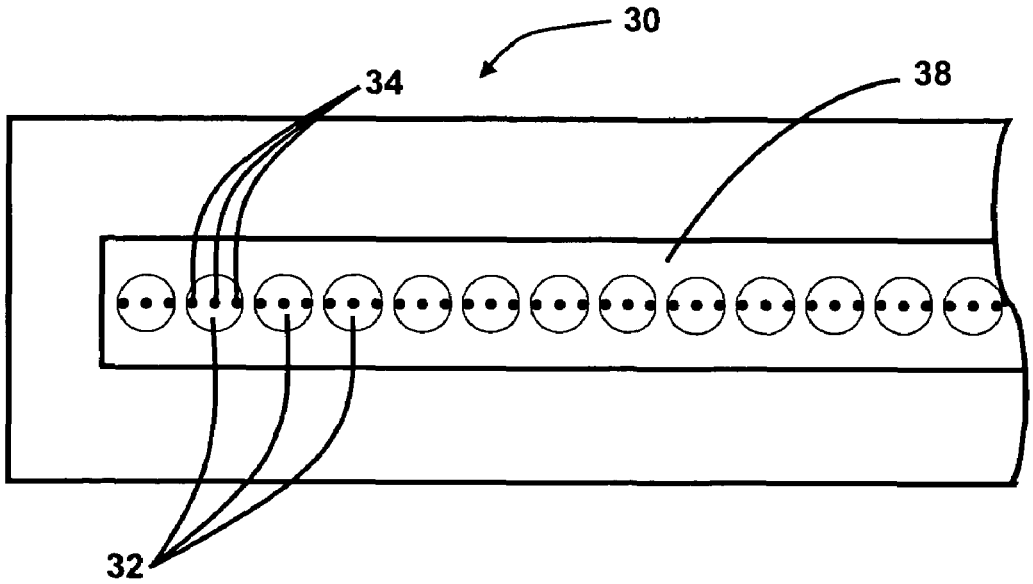

FIG. 3A illustrates in side view a cut-away diagram of another meltblowing type die 30 which includes both a single polymer distribution channel 38 formed as a slot, similar to but generally not as deep as polymer distribution channel 12 as illustrated in FIGS. 1A and 1B, and having counterbores 32 drilled or otherwise formed from the bottom of the polymer distribution channel 38. Extrusion capillaries 34 are drilled or otherwise formed extending from the bottom of or near the bottom of the counterbore 32 to the extrusion edge 36 of the die. FIG. 3B shows schematically a top view (rotated 90 degrees) of the meltblown die shown in FIG. 3A. As can be seen in FIG. 3B, the die 30 includes a single polymer distribution channel 38 along the majority of the width of the die. In the polymer distribution channel 38 are a plurality of counterbores 32 and each counterbore 32 having a plurality of extrusion capillaries 34. In the embodiment shown, each counterbore 32 supplies polymer to three capillaries 34. As was mentioned above, the number of extrusion capillaries per counterbore may of course be less than or greater than the three shown. Generally speaking, the number of extrusion capillaries will range from 1 to 10 per counterbore, and more particularly from 1 to 5 extrusion capillaries per counterbore.

Figure 4:
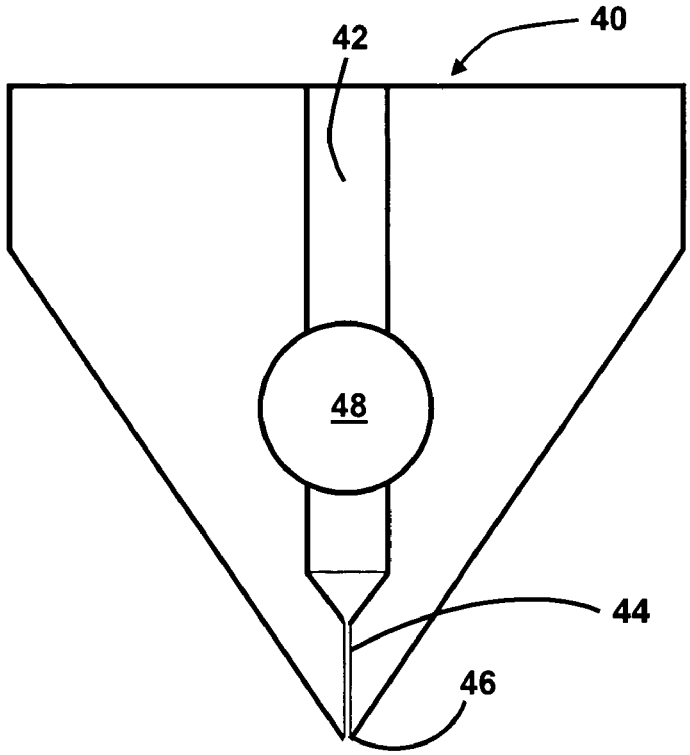
FIG. 4 illustrates schematically an embodiment of the apparatus of the invention as embodied in a meltblown die.

Turning to FIG. 4 there is shown in side view a schematic of a meltblown die 40 that includes counterbores 42 and extrusion capillaries 44 that are drilled or otherwise formed extending from the bottom of or near the bottom of counterbore 42 to the extrusion edge 46 of the die. Die 40 is similar to the meltblown die 20 shown in FIGS. 2A and 2B except it further includes adjustable insert 48 that is capable of occluding or interrupting the fluid communication between a polymer supply (not shown) and at least one extrusion capillary 44. Adjustable insert 48 fits within a cavity drilled or otherwise formed longitudinally (along the cross machine direction axis) in the die 40. In the embodiment shown in FIG. 4, the insert 48 is positioned to interrupt the fluid communication to the extrusion capillary by blocking or occluding counterbore 42. Counterbore 42 is located in cooperation with the polymer supply (not shown) that is located generally above counterbore 42 as a separate portion of the melt extrusion process attached to the meltblown die.

Figure 5:
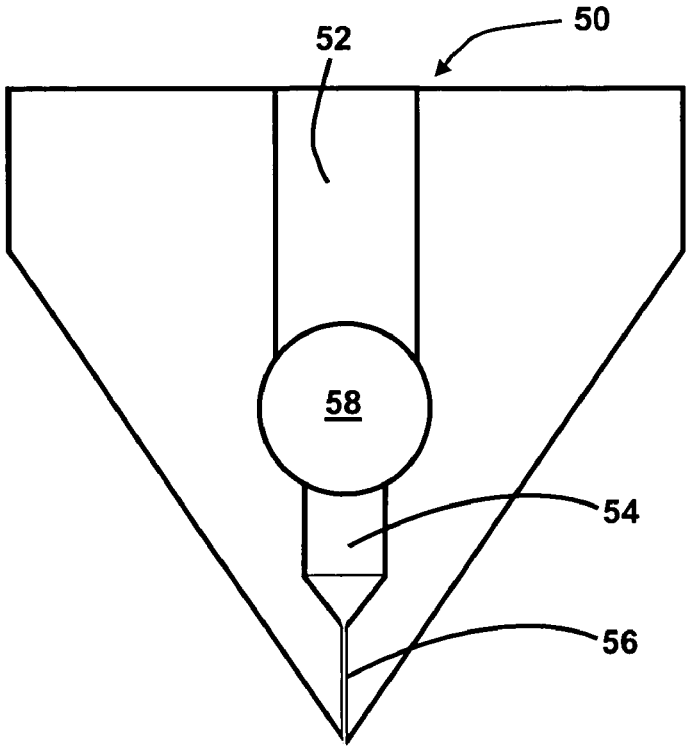
FIG. 5 illustrates schematically an embodiment of the apparatus of the invention as embodied in a meltblown die.

In use, fluidized polymer such as a molten thermoplastic polymer is pumped or otherwise provided to the die 40 by a polymer supply such as, for example, heated polymer piping (not shown), is conveyed to and flows through counterbore 42 and thus to and through extrusion capillary 44 to be extruded as fine threads or filaments or fibers of molten polymer (not shown) from capillary 44 at extrusion edge 46. However, when insert 48 is adjusted to interrupt the fluid communication between the polymer supply and the extrusion capillary, the molten or otherwise fluidized polymer is unable to flow through the counterbore to the extrusion capillary, and therefore no polymer is extruded in the form of a fiber. Similarly, the type of meltblown die that was shown in FIGS. 3A and 3B having both a slot-like polymer distribution channel and a plurality of counterbores formed from the bottom of the polymer distribution channel may desirably be configured using an adjustable insert. Such a meltblown die 50 is shown in FIG. 5, the die 50 having a slot-like polymer distribution channel 52, counterbores 54 and extrusion capillaries 56, and further including adjustable insert 58 positioned to be capable of interrupting fluid communication between polymer distribution channel 52 and counterbore 54.

In a very simple embodiment the adjustable insert may be a solid rod, such as a cylinder having a generally circular cross-section, or a flat plate having a generally rectangular cross section or a bar with a square cross-section. The rod or plate may then indexed axially (that is, indexed or pushed inwardly along the longitudinal axis of the rod, which will generally be in the cross machine direction and along the longitudinal axis of the extrusion die) in order to occlude or interrupt fluid communication such as polymer flow between the polymer supply and the extrusion capillary. As a solid rod or plate is indexed or pushed inwardly deeper into the extrusion die it sequentially occludes or interrupts fluid flow between the polymer supply generally and greater and greater numbers of the extrusion capillaries. The rod or plate is desirably placed either in or just above the counterbores. As each counterbore is occluded, polymer cannot flow to the capillary or capillaries served or supplied by the occluded counterbore and therefore no filaments will be extruded from those capillaries. As mentioned, many cross sectional shapes may be used for the insert and other cross sectional shapes are of course possible, and generally the exact shape of the insert will not be important so long as the insert is capable of being adjusted in order to occlude the counterbore and thus interrupt or block off the fluid communication between the polymer supply and the extrusion capillary or capillaries, so that polymer cannot be extruded from those extrusion capillaries for which fluid communication has been interrupted.

It should be noted that when the adjustable insert is a solid rod and when the insert has not yet been adjusted to interrupt any fluid flow, lateral fluid flow from counterbore to counterbore through the cavity provided for the insert may be possible and may not always be desirable. Therefore, the adjustable insert may desirably be a cylindrical rod having a substantially circular cross-sectional shape as was described above, but rather than being a solid rod that must be pushed into the die to occlude fluid flow, it has one or more holes drilled or otherwise formed through the insert and perpendicular to its long axis. The insert may have multiple holes drilled along its longitudinal axis in spaced apart locations matching the spacing of the counterbores. Such adjustable inserts may then be maintained at all times substantially fully within the cavity provided for the insert and adjusted by axial indexing a single time to occlude polymer flow to multiple extrusion capillaries, such that the polymer flow is occluded or interrupted when the hole or holes in the insert are no longer located in line with the counterbores. However, such an insert may also be adjusted by rotating the insert about its longitudinal axis in clockwise or counter-clockwise fashion. An example of such an adjustable insert is shown in FIG. 6A and the use of an insert in a meltblown die is shown in FIG. 6B.

Figure 6A:
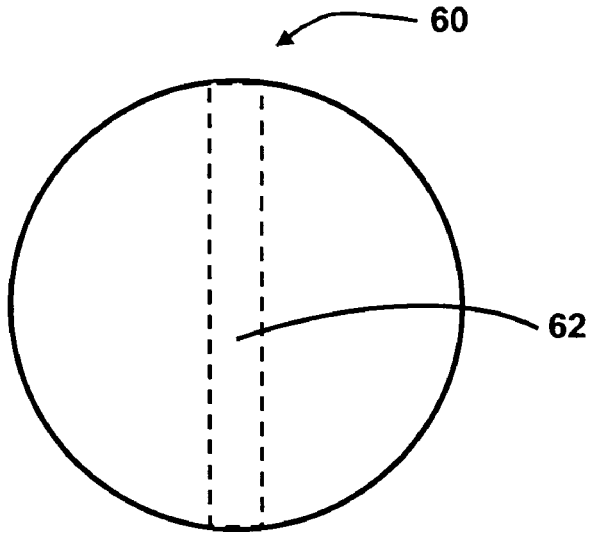
FIGS. 6A-6E illustrate embodiments of a portion of the apparatus of the invention.
Figure 6B:
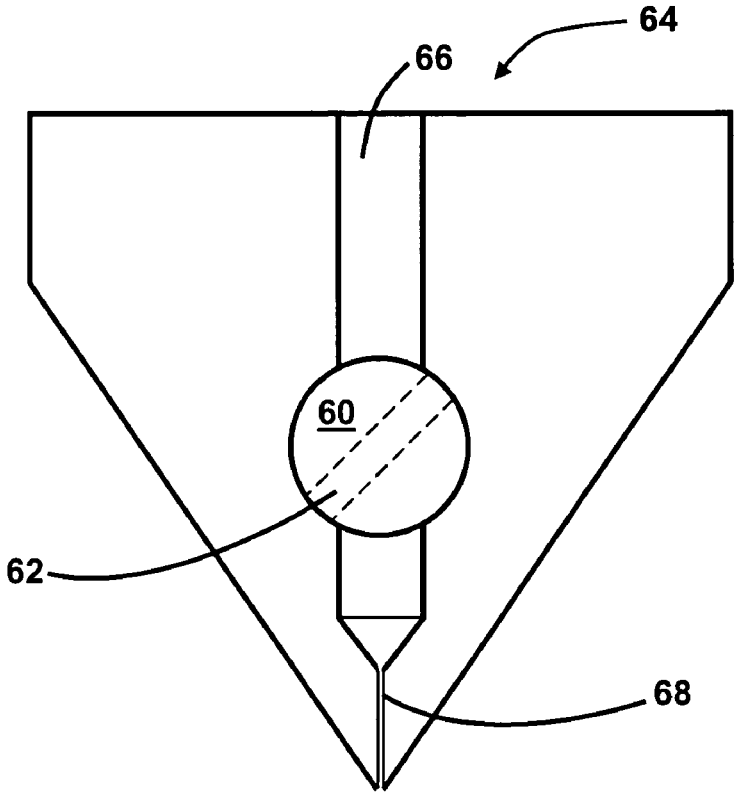

FIG. 6A illustrates in side view a cut-away diagram of an adjustable insert 60 that is a cylindrical rod having a substantially circular cross-section and having at least one hole 62 shown in phantom that is formed through the rod. In use, when adjustable insert 60 is located to be able to occlude fluid flow through a counterbore (such as when located as was shown in FIG. 4 by insert 48 located to occlude fluid flow through counterbore 42), hole 62 will allow for fluid communication through the insert 60 when hole 62 is aligned within the longitudinal axis of counterbore 42 (FIG. 4). Then, when it is desired to occlude flow between the polymer supply and the extrusion capillaries, insert 60 may be either indexed axially until hole 62 is no longer within the counterbore, or insert 60 may be adjusted by rotation until the top or the bottom portion (generally, both) of hole 62 is no longer within the counterbore, thus interrupting fluid communication to the extrusion capillary. This is shown schematically in FIG. 6B which is a side view schematic of a meltblown die 64 similar to the meltblown die 40 shown in FIG. 4. In use, when it is desired not to extrude fibers from certain extrusion capillaries, the adjustable insert 60 may be rotated as shown in FIG. 6B such that the hole 62 through the insert 60 is no longer aligned with and in the counterbore 66, thus interrupting fluid communication to any extrusion capillary 68 that is in fluid communication with a counterbore thus occluded by the adjustable insert.

Figure 6C:
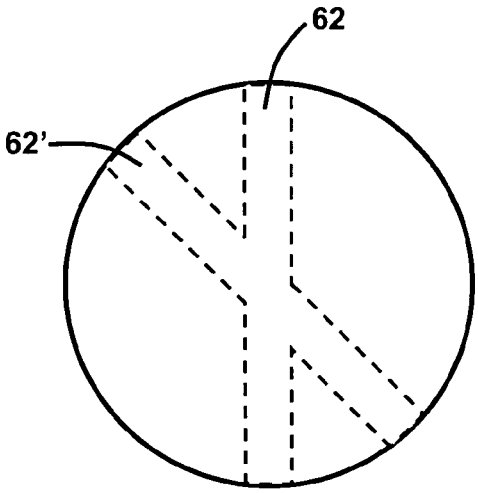
Figure 6D:
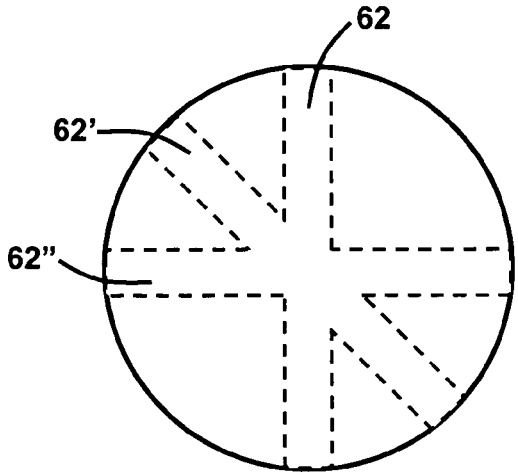

In certain embodiments, it may be desired to be able to interrupt fluid communication to one or more extrusion capillaries in a first adjustment, thereby reducing the cross-machine direction width of the filamentary curtain by a first amount, and then be able to interrupt fluid communication to greater numbers of extrusion capillaries in a second adjustment, thereby reducing the cross-machine direction width of the filamentary curtain by a second amount, and/or to interrupt fluid communication to still greater numbers of extrusion capillaries in a third adjustment, still further reducing the width of the curtain produced. As an example, in FIG. 6C and FIG. 6D are shown alternate hole arrangements wherein in FIG. 6C there may be two holes 62 and 62' drilled or formed through the insert for each counterbore served by this configuration, and as shown in FIG. 6D there may be three holes 62, 62' and 62" drilled or formed through the insert for each counterbore served. In use, for a certain desired first section or portion of the cross-machine direction width of the extrusion die and fiber extrusion process the insert may have single holes as shown in FIG. 6A matching the axial position of each counterbore in the die that is to be served by the first length of the insert. For a certain desired second portion of the extrusion die the insert may have two holes as in FIG. 6C at each position matching the axial position of each counterbore in this second portion, and for a certain desired third portion the insert may have three holes as in FIG. 6D at each position matching the axial position of each counterbore in this third portion.

When polymer is supplied to an extrusion die having such an insert, prior to adjustment the polymer will be able to flow through the counterbores to the extrusion capillaries in all three portions because each counterbore will have a hole 62 aligned within it to allow fluid communication. Then, the insert may be adjusted, for example, by rotating the adjustable insert 45 degrees in a clockwise fashion. Once so adjusted, all of the counterbores served by the insert in the first portion of the extrusion die will be occluded as shown in FIG. 6B because hole 62 will be rotated out of alignment with the counterbore. Therefore, the extrusion capillaries depending from these counterbores will no longer extrude fibers or filaments, thus reducing the cross-machine direction width of the filamentary curtain. However, all the counterbores served by the adjustable insert in the second and third portions of the extrusion die will continue to allow fluid communication through the counterbores to the extrusion capillaries via holes 62' that have now been rotated into alignment with the counterbores.

Then, when it is desired to further reduce the cross-machine direction width of the filamentary curtain, the adjustable insert may be adjusted by turning another 45 degrees in a clockwise fashion, thereby rotating holes 62' out of alignment with the counterbores and interrupting fluid communication through the counterbores in the second portion of the adjustable insert. However, the counterbores of the third portion of the extrusion die will continue to allow fluid communication through the counterbores to the extrusion capillaries via holes 62" that have now been rotated into alignment with the counterbores in the third portion. If it is desired to still further reduce the cross-machine direction width of the filamentary curtain, the adjustable insert may be adjusted by turning another 45 degrees to rotate holes 62" in the third portion out of alignment, thereby interrupting polymer flow to the extrusion capillaries that had been in fluid communication with those counterbores in the third section or portion of the extrusion die.

Figure 6E:
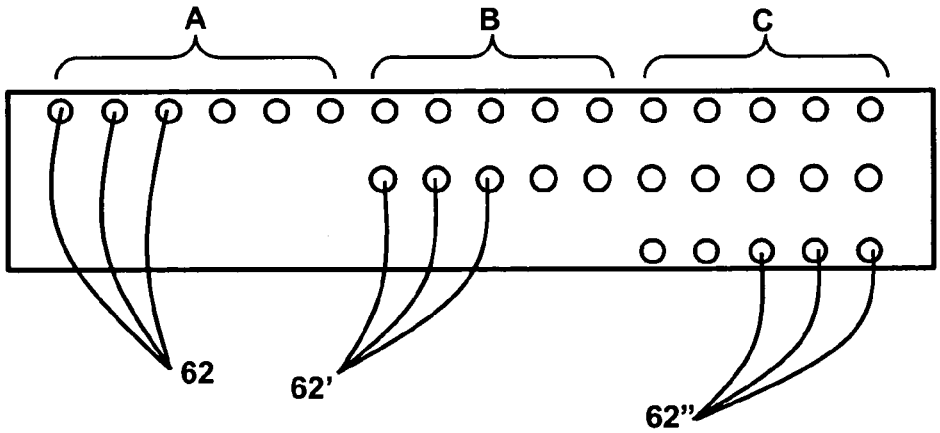

A top view of such an adjustable insert as might be used in the embodiment described above wherein multiple adjustments are capable is shown in FIG. 6E. FIG. 6E is a top view of a cylindrical rod insert such as was depicted in FIG. 6A (rotated 90 degrees) and embodying the type of hole patterns depicted in the side views in FIGS. 6A, 6C and 6D. In the first section or portion of the insert, marked by bracket A, the insert only has holes 62 at spaced apart locations, while in the second portion of the insert, marked by bracket B, the insert has holes 62 and holes 62'. Finally, in the third portion of the insert, marked by bracket C, the insert has holes 62, 62' and 62".

Figure 7:
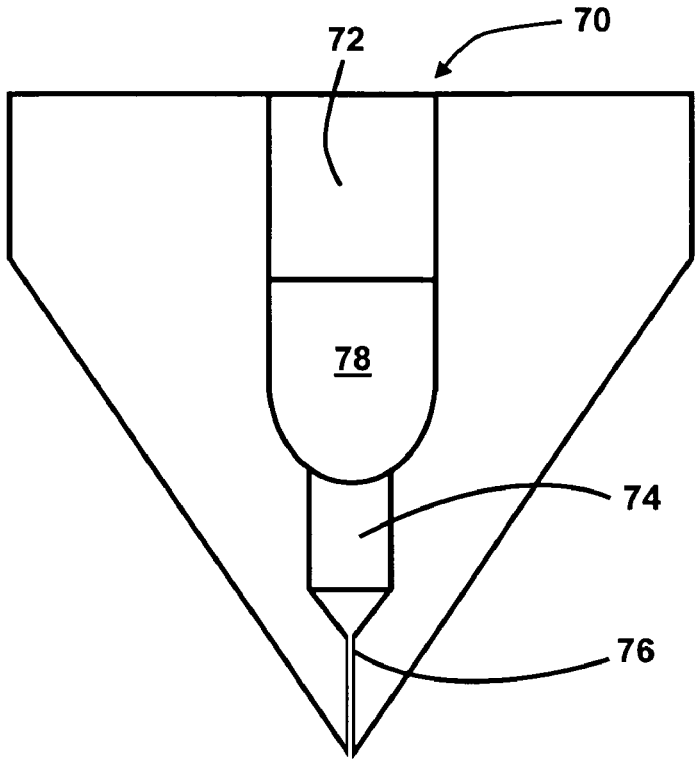
FIG. 7 illustrates an embodiment of the apparatus of the invention as embodied in a meltblown die.
Figure 8:
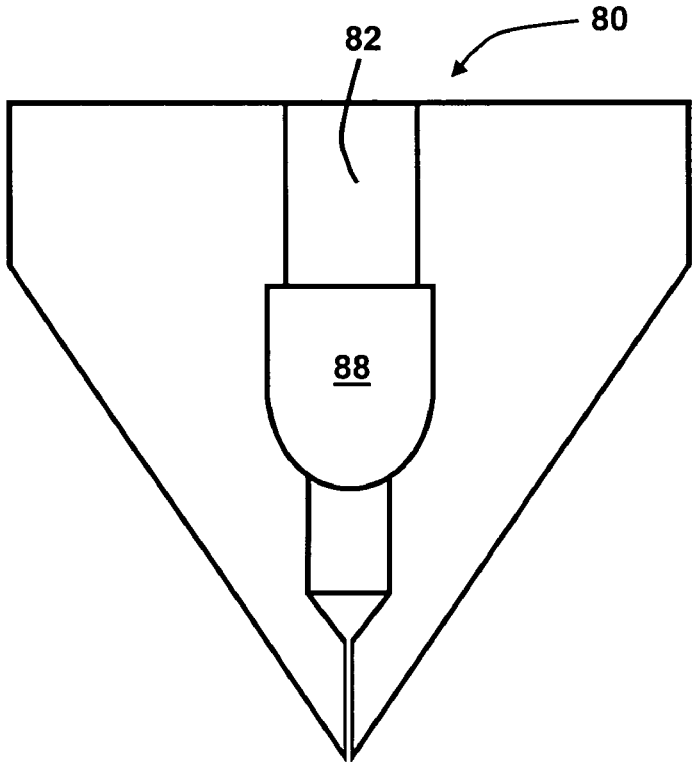
FIG. 8 illustrates an embodiment of the apparatus of the invention as embodied in a meltblown die.
Figure 9:
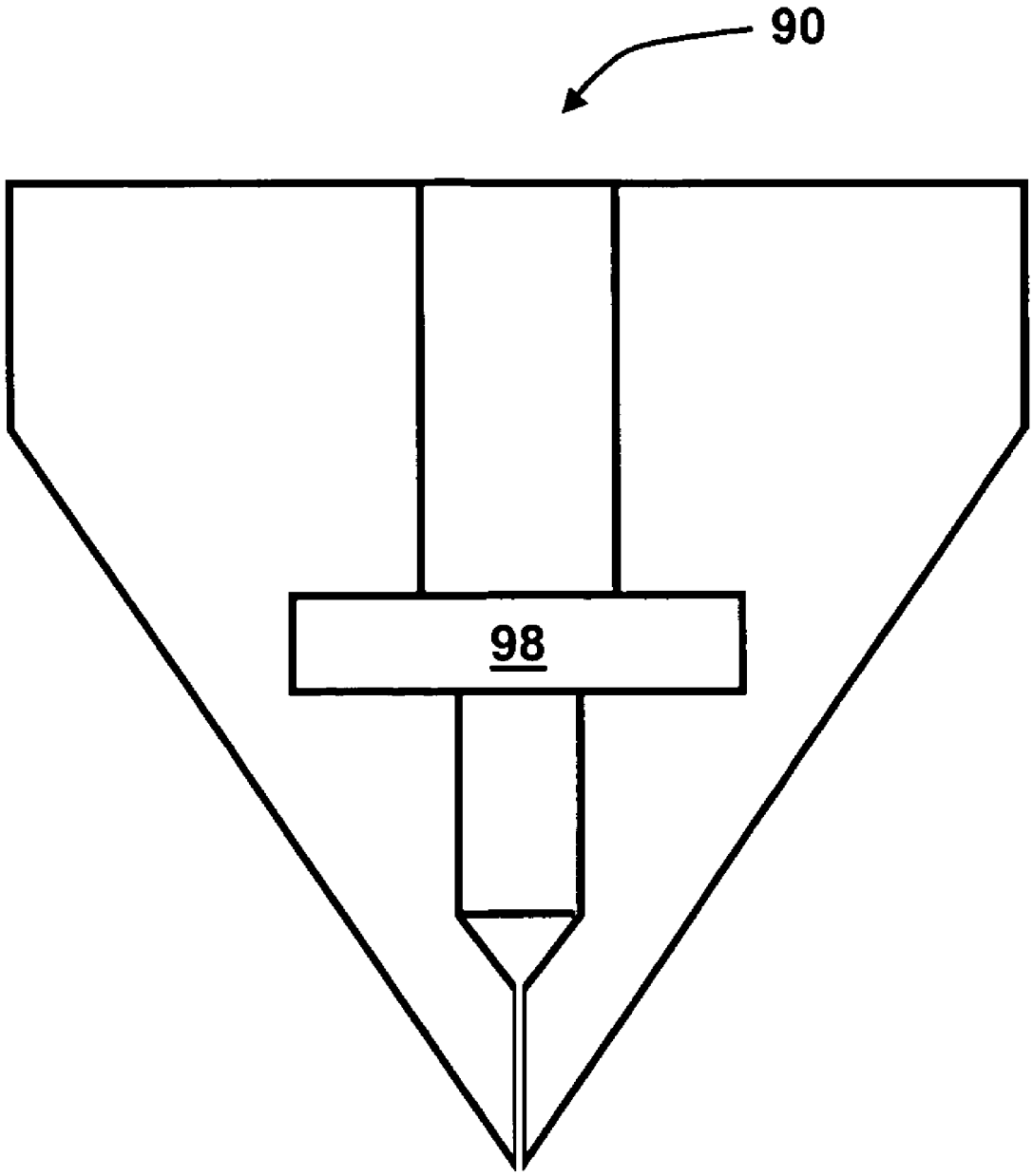
FIG. 9 illustrates an embodiment of the apparatus of the invention as embodied in a meltblown die.

Other embodiments of the apparatus of the invention as embodied in a meltblown die are shown schematically in FIGS. 7-9. In FIG. 7 there is shown in side view a cut-away diagram schematic of a meltblown die 70 which is similar to the meltblown die 50 shown in FIG. 5. Die 70 includes a slot-like polymer distribution channel 72, counterbores 74 and extrusion capillaries 76, and further includes adjustable insert 78 positioned to be capable of interrupting fluid communication between polymer distribution channel 72 and counterbore 74. However, unlike the cylindrical rod insert 58 shown in FIG. 5, adjustable insert 78 is shown as a rod having a cylindrically shaped bottom (that is, the lower half of the cross section of the rod describing a semi-circle) fitting the bottom surface of the slot-like polymer distribution channel 72.

As discussed above, where adjustable insert 78 is a solid rod it may be adjusted by indexing axially to interrupt fluid communication sequentially as it is pushed deeper and deeper into the apparatus. Alternatively, where holes are drilled through the insert matching the spacing of the counterbores, the insert 78 may be used to interrupt polymer to multiple extrusion capillaries at the same time by indexing the insert a single time. Another embodiment is shown in FIG. 8, which is similar to the apparatus shown in FIG. 7 except that for die 80 shown in FIG. 8 the adjustable insert 88 (and the space or cavity provided in the die 80 to accept the insert) is slightly wider than the width of the slot-like polymer distribution channel 82 so that the adjustable insert 88 is fully "captive" within the die 80 to avoid potential upward movement of the insert 88 within the polymer distribution channel 82. Although not mentioned with respect to FIGS. 4, 5 and 6B, the cylindrical inserts shown in those figures are also captive within the die and unable to move significantly within the die except as discussed, i.e. being rotated or being indexed along the longitudinal axis. FIG. 9 shows still another embodiment wherein the adjustable insert 98 in die 90 is a captive plate insert having a rectangular cross section.

Figure 10:
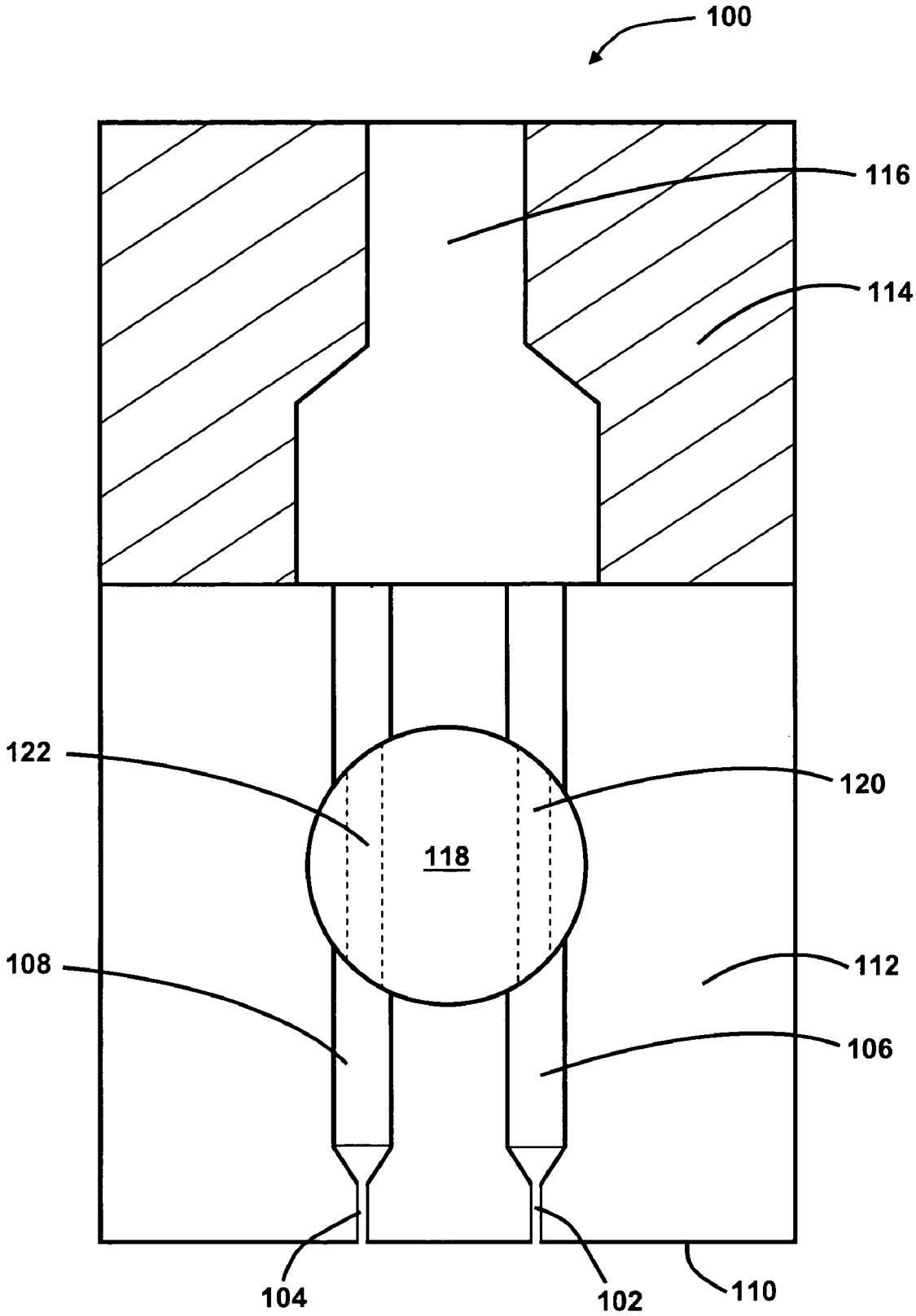
FIG. 10 illustrates the apparatus of the invention as embodied in an apparatus for the production of continuous strand filaments.

Turning to FIG. 10, there is shown in side view a cut-away diagram schematic of another filament extrusion apparatus designated generally 100 having applicability for producing larger diameter continuous filaments or strands which may, for example, be continuous elastic filaments for composite elastic materials such as are disclosed in U.S. Pat. No. 5,385,775 to Wright et al. and in PCT Publication WO 01/88245 to Welch et al., both incorporated herein by reference in their entireties. Such an extrusion die may desirably comprise a single row of extrusion capillaries arranged along the cross machine direction width of the die, as is conventional with meltblown dies, or may comprise more than one row of extrusion capillaries. The apparatus shown in FIG. 10 comprises two rows of extrusion capillaries 102 and 104 that are drilled or otherwise formed extending from the bottom of or near the bottom of respective counterbores 106 and 108 to the bottom or extrusion surface 110 of the die portion 112 of the filament extrusion apparatus 100. The extrusion apparatus further includes a polymer distributor 114 having a polymer distribution channel 116 which may be a single slot-like channel such as was discussed above with reference to meltblown dies. As shown, a single adjustable insert 118, which as shown is a cylindrical rod, is located to be capable of occluding fluid flow to and through both rows of counterbores 106 and 108.

In use, fluidized polymer such as a molten thermoplastic polymer is pumped or otherwise provided to the polymer distribution channel 116 by a polymer supply (not shown), is conveyed to and flows through counterbores 106 and 108 and thus to and through respective extrusion capillaries 102 and 104 to be extruded as continuous filaments at extrusion surface 110. When it is desired to interrupt fluid flow to the extrusion capillaries the adjustable insert 118 may be indexed axially as discussed above. Or, where the adjustable insert 118 comprises holes drilled or otherwise formed through the insert and perpendicular to its long axis such as holes 120 and 122 shown in FIG. 10 in phantom, the adjustable insert 118 may be indexed axially or more desirably rotated until holes 120 and 122 are no longer aligned within respective counterbores 106 and 108, thereby interrupting fluid flow. After drawing, the continuous filaments or strands may desirably be quenched and/or drawn to attenuate the filaments, or they may be collected without first being drawn or quenched. As used herein, the term "quench" simply means reducing the temperature of the extruded filaments using a medium that is cooler than the fibers such as using, for example, chilled air streams, ambient temperature air streams, or slightly to moderately heated air streams.

Figure 11:
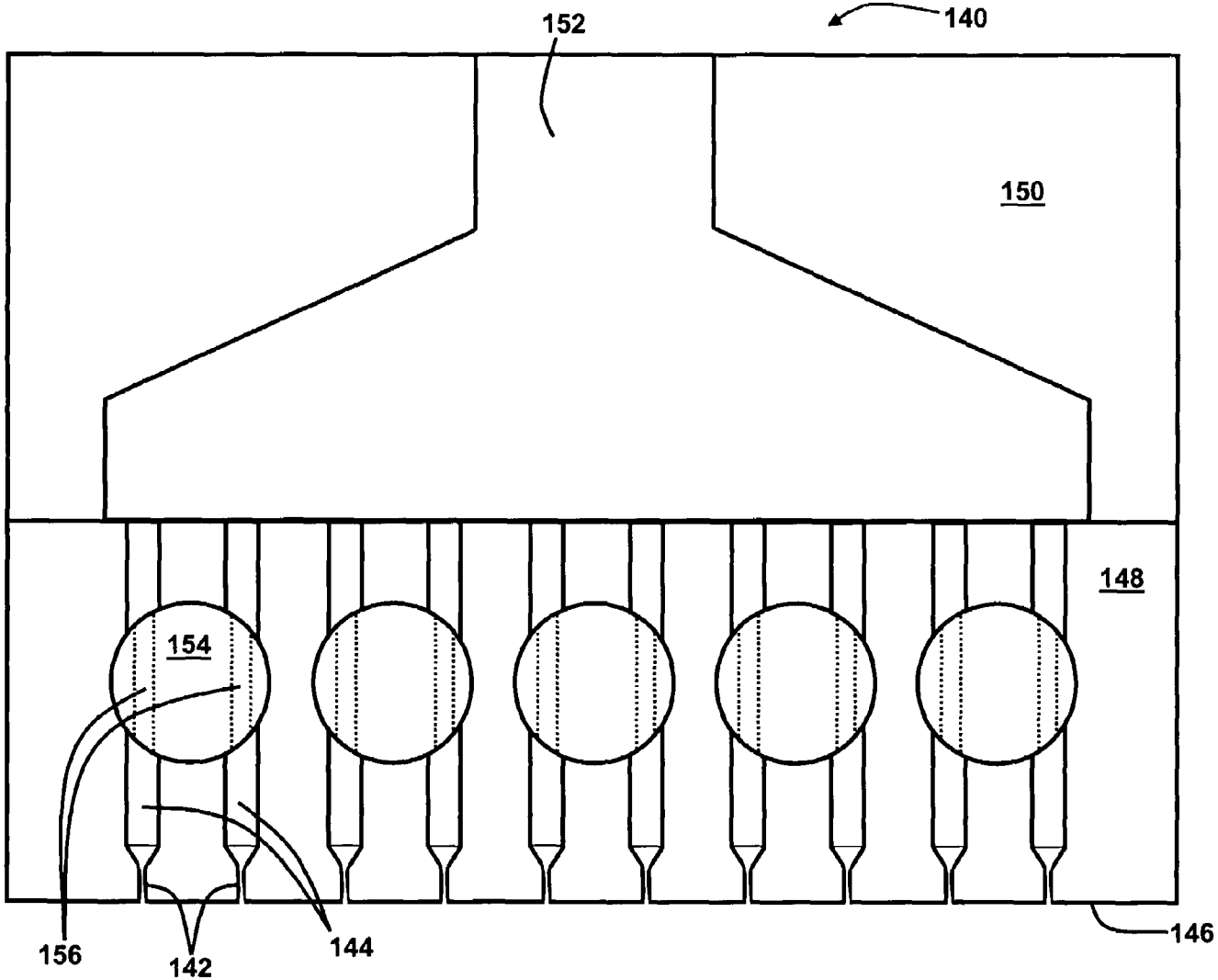
FIGS. 11 and 12 illustrate the apparatus of the invention as embodied in an apparatus for the production of continuous spunbond type filaments.

Turning to FIG. 11, there is shown in side view a cut-away diagram schematic of another filament extrusion apparatus designated generally 140 such as may be used to produce continuous spunbond type filaments. For the production of spunbond filaments, such an extrusion die desirably comprises multiple rows of extrusion capillaries arranged along the cross machine direction width of the die. The apparatus shown in FIG. 11 comprises ten rows of extrusion capillaries 142 that are drilled or otherwise formed extending from the bottom of or near the bottom of the ten rows of counterbores 144 to the extrusion surface 146 of the die portion 148 of the filament extrusion apparatus 140. The extrusion apparatus further includes a polymer distributor 150 having a polymer distribution channel 152. As shown, for each two rows of extrusion capillaries and counterbores there is located a single adjustable insert 154, which as shown is a cylindrical rod.

In use, fluidized polymer such as a molten thermoplastic polymer is pumped or otherwise provided by a polymer supply such as heated polymer piping (not shown) to the polymer distribution channel 152, is conveyed to and flows through counterbores 144 and thus to and through the extrusion capillaries 142 to be extruded as continuous filaments at the extrusion surface 146. When it is desired to interrupt fluid flow to the extrusion capillaries the adjustable inserts 154 may be indexed axially as discussed above. Or, where the adjustable inserts 154 comprise holes drilled or otherwise formed through the inserts perpendicular to their long axis such as holes 156 shown in FIG. 11 in phantom, the adjustable inserts 154 may be indexed axially or more desirably rotated until the holes 156 are no longer aligned within the counterbores 144, thereby interrupting fluid flow. As is conventional with a spunbond type filament forming process, after extrusion the filaments may desirably be quenched by, for example, blowing streams of air across the filaments shortly after they are extruded. Also, the filaments may desirably be drawn or attenuated by, for example, application of pneumatic or mechanical drawing force. After being quenched and/or drawn, the fibers may be collected on a surface such as a moving belt or other forming surface.

Figure 12:
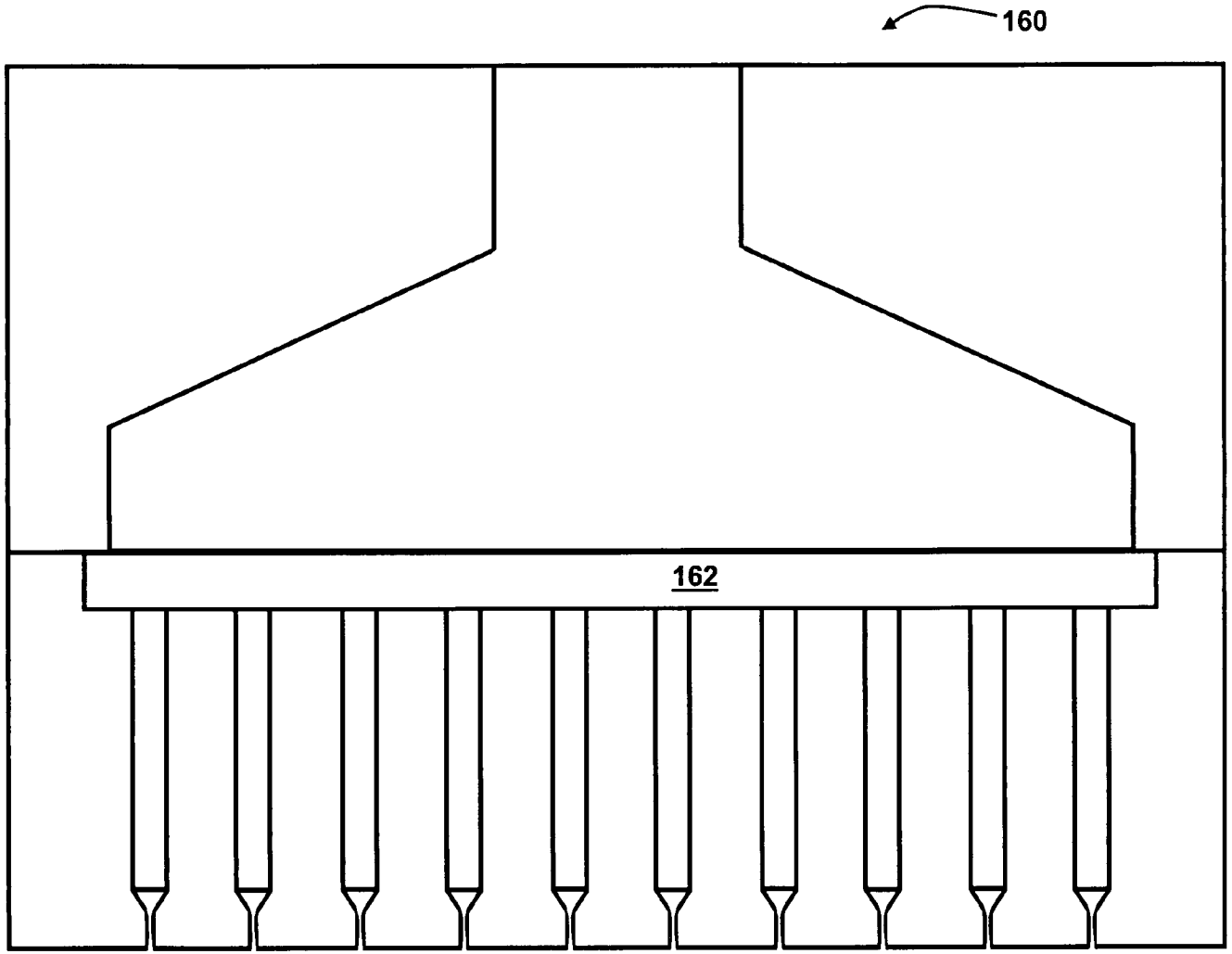
Figure 13:
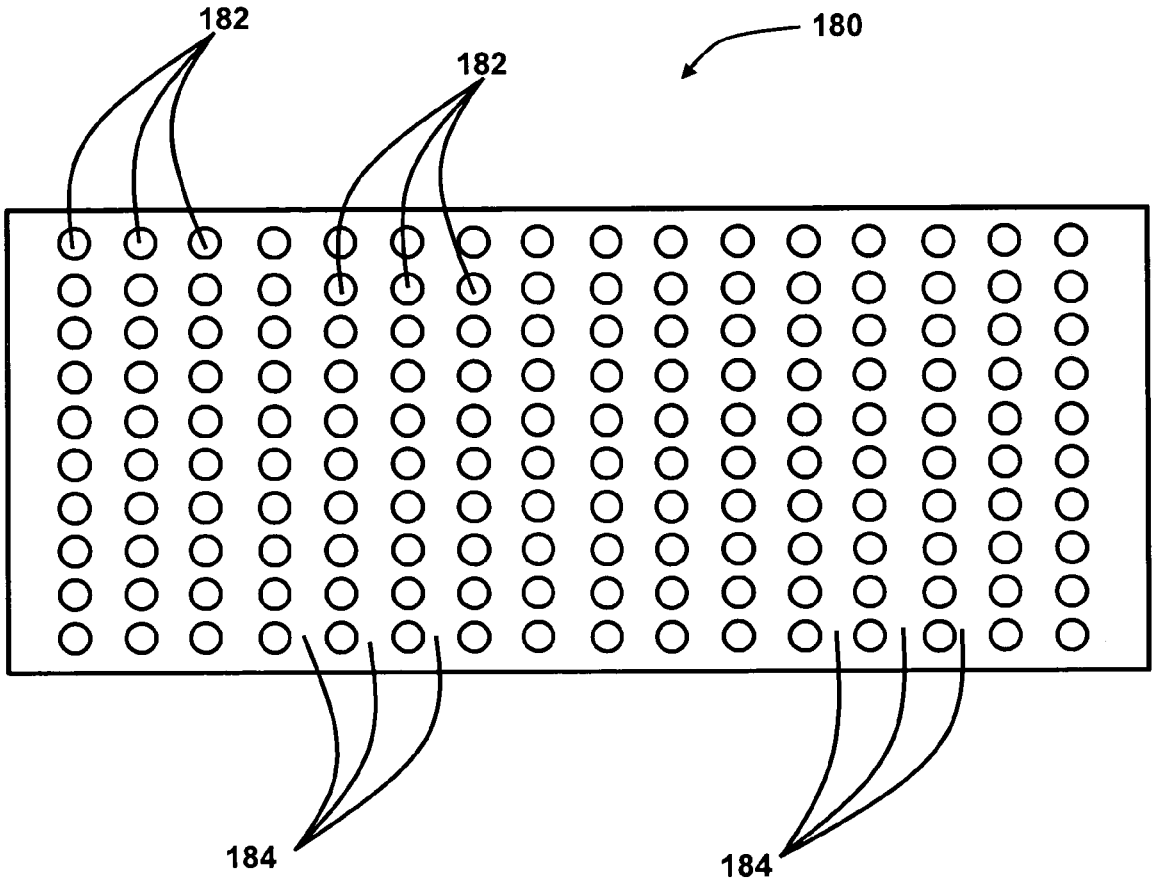
FIG. 13 illustrates a portion of an embodiment of the apparatus of the invention.

Turning to FIG. 12, there is shown in side view a cut-away diagram schematic of another filament extrusion apparatus designated generally 160 such as may be used to produce continuous spunbond type filaments. The FIG. 12 apparatus is similar to that of FIG. 11, except that the FIG. 12 apparatus makes use of a single flat plate insert 162 having a rectangular cross sectional shape rather than the multiple cylindrical rod inserts of FIG. 11. Where adjustable insert 162 is a solid plate having no holes it may be indexed incrementally into the apparatus to occlude fluid flow to, for example, ten extrusion capillaries at a time. Alternatively, it may be desirable to have holes drilled or otherwise formed through the adjustable insert at spaced apart locations matching the spacing of the counterbores. Such a plate insert is shown in FIG. 13, which is a plate generally designated 180 having a plurality of holes 182 arranged in ten rows matching the ten rows of counterbores shown in FIG. 11 and FIG. 12. Between each hole 182 is solid plate land area 184. When a plate having such a configuration of holes is indexed axially (along the cross machine direction, into the extrusion apparatus) the holes 182 will be moved out of alignment with the counterbores and the land areas 184 will then be in alignment with the counterbores, and thus the plate will serve to occlude fluid flow to and through the counterbores. In such a plate insert as shown, indexing the insert will shut off fluid flow to 160 extrusion capillaries because there are 10 rows having 16 holes each. Of course, plate inserts having fewer or greater numbers of holes may be constructed, as well as plates having fewer or greater than ten rows of holes as needed to fit the particular number of rows of counterbores in a given extrusion apparatus.

Figure 14A:
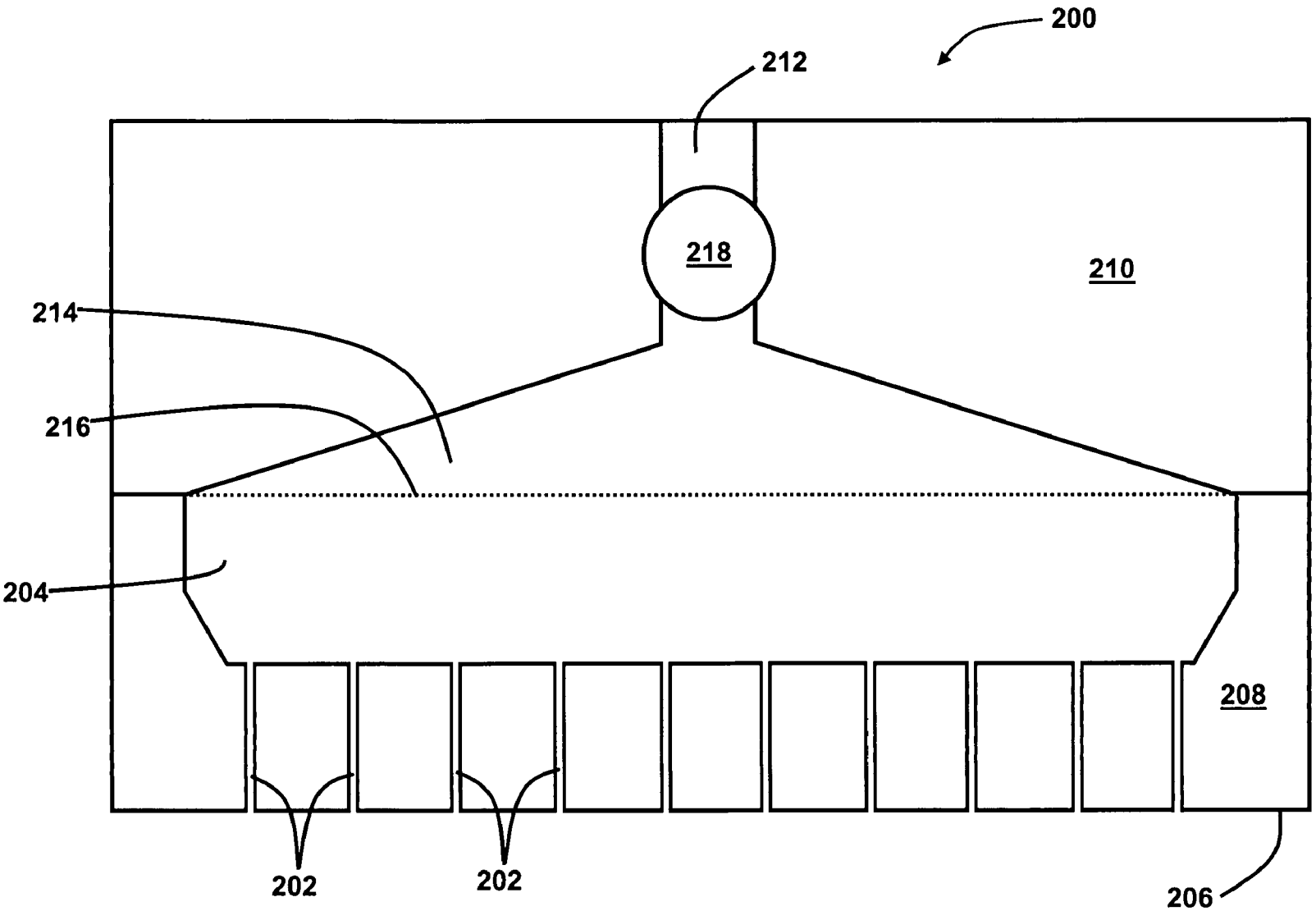
FIGS. 14A-14C illustrate the apparatus of the invention as embodied in an apparatus for the production of continuous spunbond type filaments.

Turning to FIG. 14A, there is shown in side view a cut-away diagram schematic of another filament extrusion apparatus designated generally 200 such as may be used to produce continuous spunbond type filaments and which in that respect is similar to the apparatus shown in FIG. 11. For the production of spunbond filaments, such an extrusion die desirably comprises multiple rows of extrusion capillaries arranged along the cross machine direction width of the die. The apparatus shown in FIG. 14A comprises multiple rows of extrusion capillaries 202 that are drilled or otherwise formed extending from the bottom of the supply slot 204 to the extrusion surface 206 of the die portion 208 of the filament extrusion apparatus 200. Supply slot 204 is a generally rectangular-shaped slot that has been milled or otherwise formed out of the die portion 208. Supply slot 204 has its long axis oriented along the machine direction dimension of the extrusion apparatus. The extrusion apparatus further includes a distributor portion 210 having a single counterbore 212 drilled or otherwise formed into it. Counterbore 212 may be generally cylindrical and allows for fluid communication with or feeds into an expanding slot 214. The expanding slot 214 has been milled or otherwise formed out of the distributor portion 210. The expanding slot 214 at its lowest point or interface with supply slot 204 and will generally have the same rectangular shape as the supply slot 204. The interface of the expanding slot 214 and the supply slot 204 is shown by dotted line 216. The extrusion apparatus 200 further includes an adjustable insert 218. The adjustable insert 218 shown in FIG. 14A is shown as a cylindrical rod positioned with its long axis through and perpendicular to the long axis of the counterbore 212. The adjustable insert 218 is capable of interrupting fluid communication with all of the extrusion capillaries 202 that are fed by counterbore 212 and the supply slot 204.

In use, fluidized polymer such as a molten thermoplastic polymer is pumped or otherwise provided to the counterbore 212 by a polymer supply (not shown), is conveyed through the counterbore 212 and flows downwardly to and through the expanding slot 214 and the supply slot 204 and thus to and through the extrusion capillaries 202 to be extruded as continuous filaments at the extrusion surface 206. When it is desired to interrupt fluid flow to the extrusion capillaries the adjustable insert 218 may be indexed axially as discussed above. Or, where the adjustable insert 218 comprises holes drilled or otherwise formed through the insert perpendicular to its long axis such as was discussed above, the adjustable insert 218 may be indexed axially or more desirably rotated until the holes are no longer aligned within the counterbore, thereby interrupting fluid flow. The adjustable insert may also comprise areas having multiple holes such as was discussed with respect to FIGS. 6C-6E. The adjustable insert may alternatively be a flat plate, with or without holes drilled therethrough, as was discussed above.

Figure 14B:
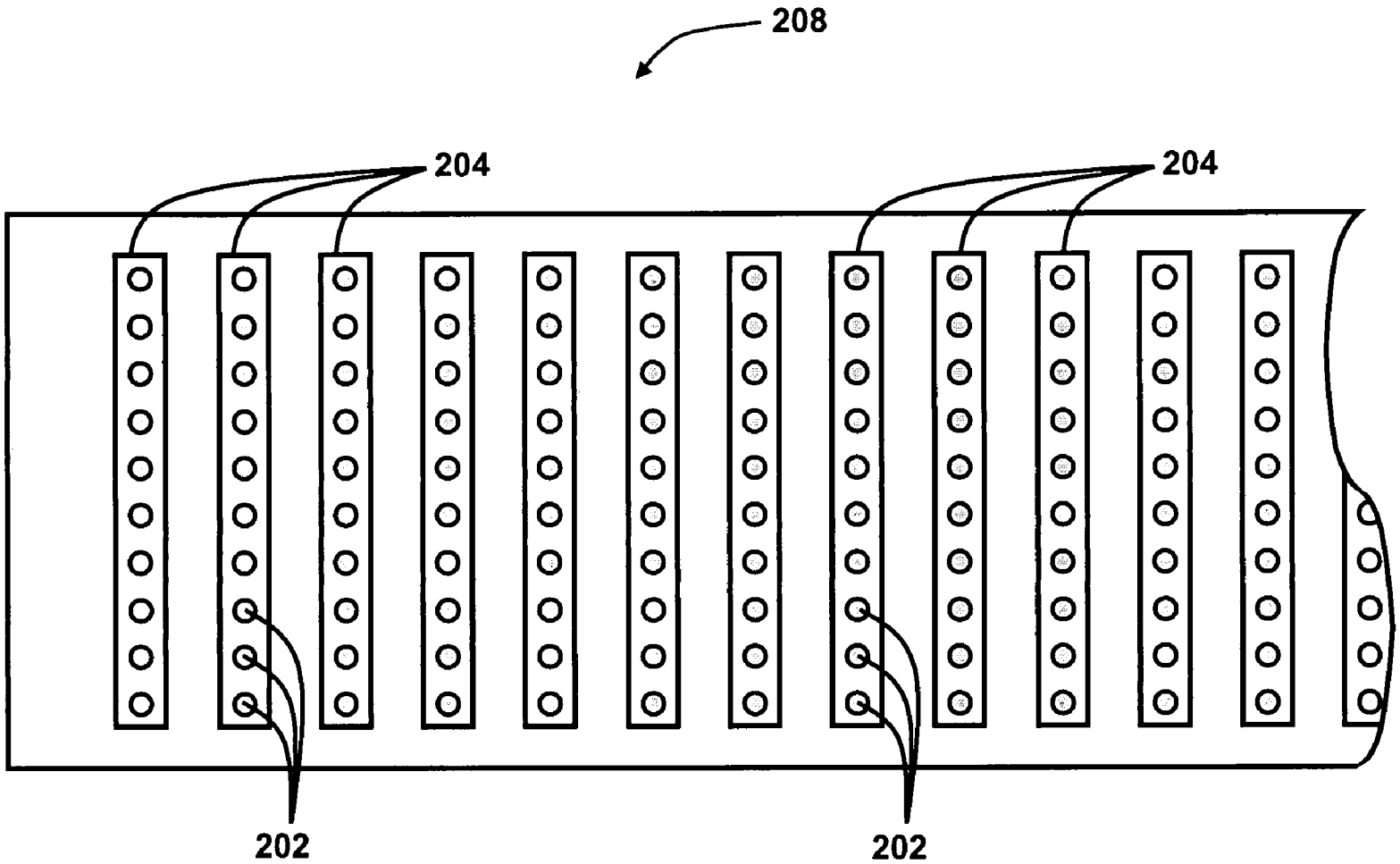
Figure 14C:
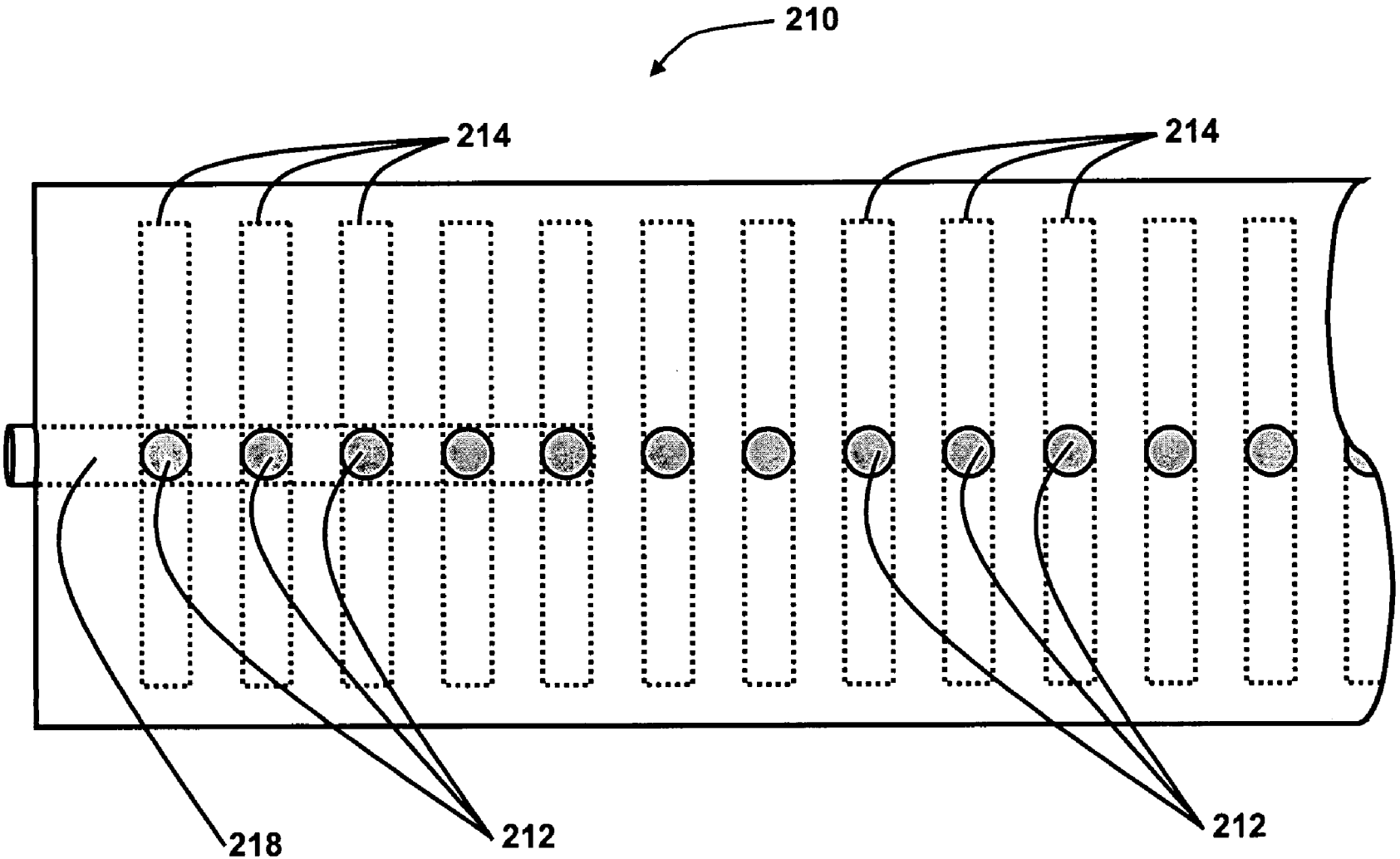

Turning to FIGS. 14B and 14C, there is shown in top-view (rotated 90 degrees) schematic representations of the two portions of the extrusion apparatus shown in side view in FIG. 14A. FIG. 14B shows the die portion 208 of the apparatus, which includes a plurality of supply slots 204 that are generally rectangular-shaped slots having their long axis oriented along the machine direction dimension of the extrusion apparatus. Each supply slot 204 has a number of extrusion capillaries 202 drilled or otherwise formed along its bottom in a column. FIG. 14C shows the distributor portion 210 of the extrusion apparatus that includes a plurality of expanding slots 214 (shown in phantom) that are generally rectangular-shaped slots having their long axis oriented along the machine direction dimension of the extrusion apparatus. Each of expanding slots 214 has a single counterbore 212 drilled or otherwise formed downward from the top of the distributor portion 210 to connect to the expanding slot 214. Also shown in FIG. 14C is adjustable insert 218 (shown in phantom for the portion within the distributor portion 210 of the apparatus). For the embodiment shown, for example, the adjustable insert is positioned to be able to interrupt fluid flow from five of the counterbores 212, and thus reduce the cross-machine direction extruded width of a filamentary curtain produced with this apparatus by interrupting fluid flow to all the capillaries served by the 5 counterbores on that end of the extrusion apparatus.

In another embodiment of the extrusion apparatus shown in FIGS. 14A-14C, each supply slot may have multiple columns of extrusion capillaries drilled or otherwise formed in its bottom, instead of the single column as was shown in FIG. 14B. Where two or more columns of extrusion capillaries are formed in each supply slot it may be desirable to have the capillaries arranged in an offsetting or staggered pattern, such that one column of capillaries is arranged about one half of the machine direction capillary-to-capillary spacing distance further toward one machine direction edge of the apparatus than a neighboring column of capillaries. In addition, it should be noted that the number of extrusion capillaries in the machine direction columns (ten capillaries per column) is solely for the purposes of illustration in FIGS. 11-14C and may desirably be a greater or lesser number depending on die design constraints, amount of filaments desired, overall filament production throughput rate desired, and other factors.

Although the embodiments of the invention have been described with respect to apparatus conventionally utilized in the melt extrusion of various types thermoplastic filaments, we believe the invention is not limited thereto and may also be beneficially used in controlling the extruded width of filamentary curtains in other types of filament extrusion processes such as for example in flash spun filament production processes and in solution spun filament production processes. However, the invention may be particularly well suited to the extrusion of thermoplastic polymer filaments. Polymers generally suitable for extrusion from a thermoplastic melt include the known polymers suitable for production of nonwoven webs and materials such as for example polyolefins, polyesters, polyamides, polycarbonates and copolymers and blends thereof. It should be noted that the polymer (or polymers, where it is desired to produce multicomponent or multiconstituent filaments) may desirably contain other additives such as processing aids or treatment compositions to impart desired properties to the filaments, residual amounts of solvents, pigments or colorants and the like.

Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly (2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include poly lactide and poly lactic acid polymers as well as polyethylene terephthalate, poly-butylene terephthalate, polytetramethylene terephthalate, polycyclohexylene-1,4-dimethylene terephthalate, and isophthalate copolymers thereof, as well as blends thereof.

In addition, many elastomeric polymers are known to be suitable for forming filaments. Elastic polymers useful in making extruded filaments may be any suitable elastomeric filament forming resin including, for example, include elastic polyesters, elastic polyurethanes, elastic polyamides, elastic co-polymers of ethylene and at least one vinyl monomer, block copolymers, and elastic polyolefins. Examples of elastic block copolymers include those having the general formula A-B-A' or A-B, where A and A' are each a thermoplastic polymer endblock that contains a styrenic moiety such as a poly (vinyl arene) and where B is an elastomeric polymer midblock such as a conjugated diene or a lower alkene polymer such as for example polystyrene-poly(ethylene-butylene)-polystyrene block copolymers. Also included are polymers composed of an A-B-A-B tetrablock copolymer, as discussed in U.S. Pat. No. 5,332,613 to Taylor et al. An example of such a tetrablock copolymer is a styrene-poly(ethylene-propylene)-styrene-poly(ethylene-propylene) or SEPSEP block copolymer. These A-B-A' and A-B-A-B copolymers are available in several different formulations from the Kraton Polymers of Houston, Tex. under the trade designation KRATON®.

Examples of elastic polyolefins include ultra-low density elastic polypropylenes and polyethylenes, such as those produced by "single-site" or "metallocene" catalysis methods. Such polymers are commercially available from the Dow Chemical Company of Midland, Mich. under the trade name ENGAGE®, and described in U.S. Pat. Nos. 5,278,272 and 5,272,236 to Lai et al entitled "Elastic Substantially Linear Olefin Polymers". Also useful are certain elastomeric polypropylenes such as are described, for example, in U.S. Pat. No. 5,539,056 to Yang et al. and U.S. Pat. No. 5,596,052 to Resconi et al., incorporated herein by reference in their entireties, and polyethylenes such as AFFINITY® EG 8200 from Dow Chemical of Midland, Mich. as well as EXACT® 4049, 4011 and 4041 from Exxon of Houston, Tex., as well as blends.

EXAMPLES

Example 1

A 56 centimeter (cm) long (cross-machine direction dimension) meltblowing apparatus die having 3.43 cm long vertical counterbores in the die such as are described above and in U.S. Pat. No. 6,579,084 to Cook was modified by having 1.0 cm diameter cylindrical cavities drilled into it from both ends, parallel to the cross machine direction axis of the meltblowing apparatus. The cavities were 19 cm long and extended perpendicularly across the space occupied by 50 counterbores each, and were situated such that they passed through the counterbores approximately 1.1 cm from the top of the counterbore or counterbore entry. Each cavity was then fitted with a solid cylindrical rod inserted into the meltblowing apparatus approximately 3.5 cm, such that the rod did not yet occlude fluid flow through any of the counterbores. The counterbores were machined on 0.254 cm centers, and comprised the center 48 cm portion of the die. Thus, the first counterbore was approximately 4 cm from the ends where the rods were inserted. Each counterbore had three extrusion capillaries drilled from the bottom of the counterbore to the bottom extrusion surface or edge of the meltblowing die.

A commercially available polypropylene polymer was melted by an extruder and supplied to the meltblowing apparatus and was pumped through a polymer supply channel and thus was conveyed to and through all the available counterbores and thus to the extrusion capillaries. As the molten polymer was extruded from the extrusion capillaries it was entrained in and drawn by converging high velocity air streams which attenuated the polymer filaments to form meltblown filaments. The meltblown filaments were collected onto a moving foraminous forming surface to form a meltblown mat or web of fibers having about a 48 cm cross machine direction width. Then, when it was desired to reduce the cross machine direction width of the web of meltblown fibers, the adjustable inserts were adjusted by indexing the cylindrical rods further into the meltblown die about 12 cm each to occlude fluid flow through the counterbores and thus to interrupt polymer flow to the extrusion capillaries. The web thus produced after adjustment of the adjustable insert was 24 cm in cross machine direction width, having been reduced by about 12 cm in width on each side of the web. It should be noted that where desired to reduce the cross machine direction width of the web from only one side, only one of the adjustable inserts would be adjusted by indexing into the apparatus.

Example 2

A 60 centimeter (cm) long (cross-machine direction dimension) continuous strand filament apparatus similar to the apparatus shown in FIG. 10 and having 3.5 cm long vertical counterbores in the die with two rows of capillaries, spaced 0.635 cm apart, was modified by having 1.0 cm diameter cylindrical cavities drilled into it from both ends, parallel to the cross machine direction axis of the apparatus. The cavities were 12.7 cm long and extended perpendicularly across the space occupied by 39 counterbores each, and were situated such that the cavity (and adjustable insert, when so fitted into the apparatus) passed through both rows of counterbores approximately 2.5 cm from the top of the counterbores. Each cavity was then fitted with a solid cylindrical rod as an adjustable insert that was inserted approximately 4 cm, such that the rod did not yet occlude fluid flow through any of the counterbores. The counterbores were machined on 0.2 cm centers, and comprised the center 50 cm portion of the die. Thus, the first counterbore was approximately 5 cm from the ends of the apparatus where the rods were inserted. Each counterbore had one extrusion capillary drilled from the bottom of the counterbore to the bottom extrusion surface or edge of the continuous strand filament die.

A commercially available polypropylene polymer was melted by an extruder and supplied to the filament apparatus and was pumped through a polymer supply channel and thus conveyed to and through all the available counterbores and thus to the extrusion capillaries to form continuous strand filaments. The filaments were collected onto a moving foraminous forming surface to form a filament mat of fibers having about a 48 cm cross machine direction width. Then, when it was desired to reduce the cross machine direction width of the fiber curtain produced, the two adjustable inserts were adjusted by indexing the cylindrical rods further into the extrusion die about 13 cm to occlude fluid flow through the counterbores and thus to interrupt polymer flow to the extrusion capillaries. The filament mat thus produced after adjustment of the adjustable inserts was 34 cm in cross machine direction width, having been reduced by about 7 cm in width on each side of the web. It should be noted that where desired to reduce the cross machine direction width of the filament curtain extruded from only one side, only one of the adjustable inserts would be adjusted by indexing into the apparatus.

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

The invention claimed is:

1. An apparatus for extruding filaments, said apparatus comprising:

a) an extrusion die;

b) a polymer supply in fluid communication with said extrusion die;

c) a plurality of extrusion capillaries in said extrusion die;

d) a plurality of counterbores in said extrusion die allowing fluid communication between said capillaries and said polymer supply;

e) an adjustable insert for interrupting said fluid communication between said polymer supply and at least one of said extrusion capillaries; and wherein said insert is a rod having a substantially circular cross section, a diameter and a length, said rod having at least a first portion and a second portion along said length, said first portion having at a plurality of spaced apart locations a single hole through said diameter, and said second portion having at a plurality of spaced apart locations at least two holes through said diameter.

2. The apparatus of claim 1 further comprising a second adjustable insert for interrupting said fluid communication between said polymer supply and at least one of said extrusion capillaries, wherein said second adjustable insert is a rod having a substantially circular cross section, a diameter and a length, said rod having at least a first portion and a second portion along said length, said first portion having at a plurality of spaced apart locations a single hole through said diameter, and said second portion having at a plurality of spaced apart locations at least two holes through said diameter.

* * * * *